United States Patent [19]

McAdams

[11] Patent Number: 4,879,861

[45] Date of Patent: Nov. 14, 1989

[54] METHOD FOR PACKAGING FIREWOOD AND THE APPARATUS THEREOF

[76] Inventor: William J. McAdams, 3006R N. Main St., Ft. Worth, Tex. 76106

[21] Appl. No.: 183,903

[22] Filed: Apr. 20, 1988

[51] Int. Cl.[4] ..... B65B 53/06; B65B 67/08

[52] U.S. Cl. ..... 53/435; 53/390; 53/442

[58] Field of Search ..... 53/411, 442, 434, 441, 53/440, 447, 510, 512, 534, 540, 557, 390, 435; 414/35, 97

[56] References Cited

U.S. PATENT DOCUMENTS

| | | | |
|---|---|---|---|
| 2,720,323 | 10/1955 | Hoiles | 414/97 X |
| 3,529,717 | 9/1970 | McDougal | 53/447 X |
| 3,589,510 | 6/1971 | Begnaud et al. | 53/557 X |
| 3,662,512 | 5/1972 | Zelnick | 53/447 X |
| 4,220,431 | 9/1980 | Place et al. | 414/97 X |
| 4,268,201 | 5/1981 | Cayton | 414/97 X |
| 4,500,001 | 2/1985 | Daniels | 53/441 X |
| 4,546,593 | 10/1985 | Lasscock | 53/441 |
| 4,575,989 | 3/1986 | Hannen | 53/442 X |

*Primary Examiner*—Robert L. Spruill

*Assistant Examiner*—Beth Bianca

*Attorney, Agent, or Firm*—Richard C. Litman

[57] ABSTRACT

A method and apparatus for packaging firewood and kindling material wherein said device includes a rigid support frame for stacking and packaging. The rigid support frame includes a base member, a vertical support member hingedly affixed to said base member, and a truss member detachably affixed to said vertical support member at one end and pivotably affixed to said base member on its opposing end. The firewood is vertically positioned on said frame in a multiplicity of layers, wherein each layer is positioned in substantially normal axial displacement to one another, thus preventing lateral stability during said packaging procedure. A shrink wrap material is provided along with a heating element, e.g., hand held air blower, such that said shrink wrap may be applied to encase said vertically positioned firewood, and its corresponding kindling material. The method and apparatus of the invention thereby provides a transportable package of firewood along with a combustible material, i.e., kindling encased within a shrink wrap package. The packaged firewood may be used for either home or recreational use.

8 Claims, 4 Drawing Sheets

METHOD FOR PACKAGING FIREWOOD AND THE APPARATUS THEREOF

BACKGROUND OF THE INVENTION

1. Field of the Invention

The invention relates to a method and an apparatus for packaging firewood along with a combustible material, e.g., kindling, wherein a thermally shrinkable plastic material is placed over a plurality of layers of firewood. Each layer is positioned in substantially normal axial displacement to one another, thus providing lateral stability during packaging thereof.

Homeowners are increasingly becoming more aware of ways to conserve energy. This is in an attempt to make their homes a more profitable investment. Thus, the fireplace has been revived, as both an energy conserving tool as well as a means for providing more aesthetic value to the home.

Splitting firewood is both time consuming and a cumbersome act, especially during seasons of inclement weather. Although split firewood is available, and may be stored in one's home or backyard, transporting and handling of individual pieces of split firewood generally results in undesirable results, e.g., splinters in the hands of the user, and unwanted pieces of wood. Packaged firewood, generally available in single layers, is frequently unstable during storage of large quantities, and is normally accessible only in loose fitting containers.

Therefore, the present invention, a method for packaging firewood and an apparatus used therewith, which is safe in use and inexpensive in manufacture, is disclosed. More particularly, the invention contemplates a method for stacking and packaging split firewood within a heat shrinkable package in such a manner so as to limit lateral instability during packaging and storage of same. Also provided within the package is a combustible material, i.e., kindling, which is used as a fire starting agent.

The method of construction of the invention is more fully described herein.

2. Description of the Prior Art

Various prior art methods and apparatus for packaging goods, as well as the method of their construction in general, are known and are found to be exemplary of the U.S. prior art. They are:

| U.S. Pat. No. | Inventor |
|---|---|
| 4,631,898 | D. Brambilla |
| 4,597,189 | A. Cutrara |
| 4,575,989 | R. Hannen |
| 4,562,689 | R. Hannen |
| 3,986,611 | D. Dreher |
| 3,662,512 | S. Zelnick |
| 3,600,871 | M. Farquhar |
| 3,529,717 | D. McDougal |

U.S. Pat. No. 4,597,189 issued to A. Cutrara contemplates a process for curing the "green" wood within a heat shrinkable thermoplastic netting, thus providing individual bags of palletized kiln dried firewood.

U.S. Pat. No. 4,575,989 issued to R. W. Hannen discloses a Method and Device for Packaging Palletized Stacks of Goods which includes a conveyer device for transporting the respective pallets to a shrink station for individual wrapping.

U.S. Pat. No. 3,529,717 issued to D. A. McDougal discloses a palletized means of tightly heat shrinking a load of firewood to prevent lateral movement of its enclosed materials.

The remaining patents disclose various methods of heat shrinking an envelope about a palletized array of goods.

These patents, or known prior art uses, teach and disclose various methods and apparatus for packaging goods of various manufactures, and the like, as well as methods of their construction; but none of them, whether taken singly or in combination, disclose the specific details of the combination of the invention in such a way as to bear upon the claims of the present invention.

More specifically, none of the prior art patents disclose a method and apparatus for stacking split firewood, wherein the method includes vertically positioning a multiplicity of layers of firewood in normal axial displacement to one another and enveloping same within a thermally shrinkable heat wrap material, thus limiting lateral displacement of said firewood and kindling material during packaging and transport thereof.

SUMMARY OF THE INVENTION

An object of the present invention, a method for packaging firewood and an apparatus used therewith, is to provide a method for packaging split firewood along with the corresponding kindling material thereof. It is another object of the present invention to provide a method of limiting lateral displacement or instability of the firewood during stacking and packaging of same.

A related object of the present invention is to provide an apparatus to facilitate the packaging of firewood and kindling material by this method.

With these and other objects in view which will more readily appear as the nature of the invention is better understood, the invention consists in the novel construction, combination and arrangements of parts hereinafter more fully described, illustrated and claimed, with reference being made to the appended drawing.

BRIEF DESCRIPTION OF THE VIEWS

FIGS. 3, 3A, 3B, and 3C further illustrate the apparatus for packaging firewood, wherein the hinge member, pivoting member, and fastening pin member are enlarged for greater clarity.

Figure 4A:
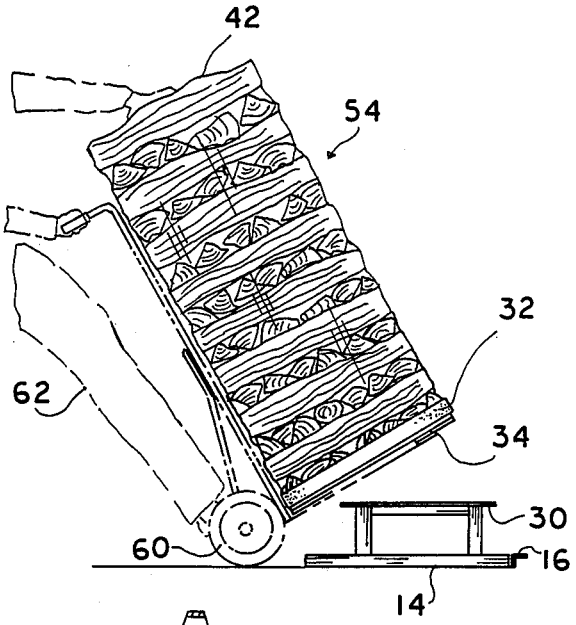
Figure 3:
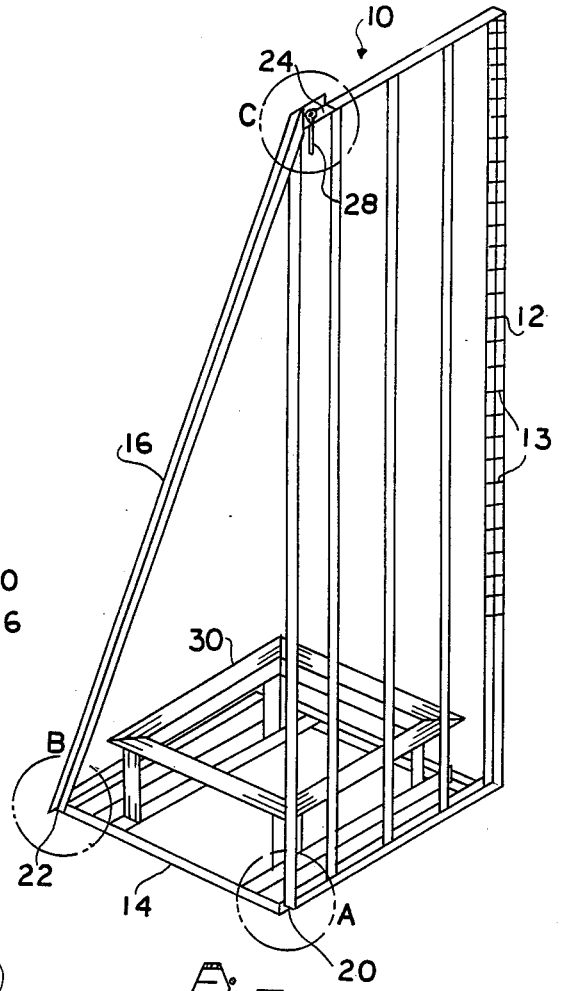
Figure 4:
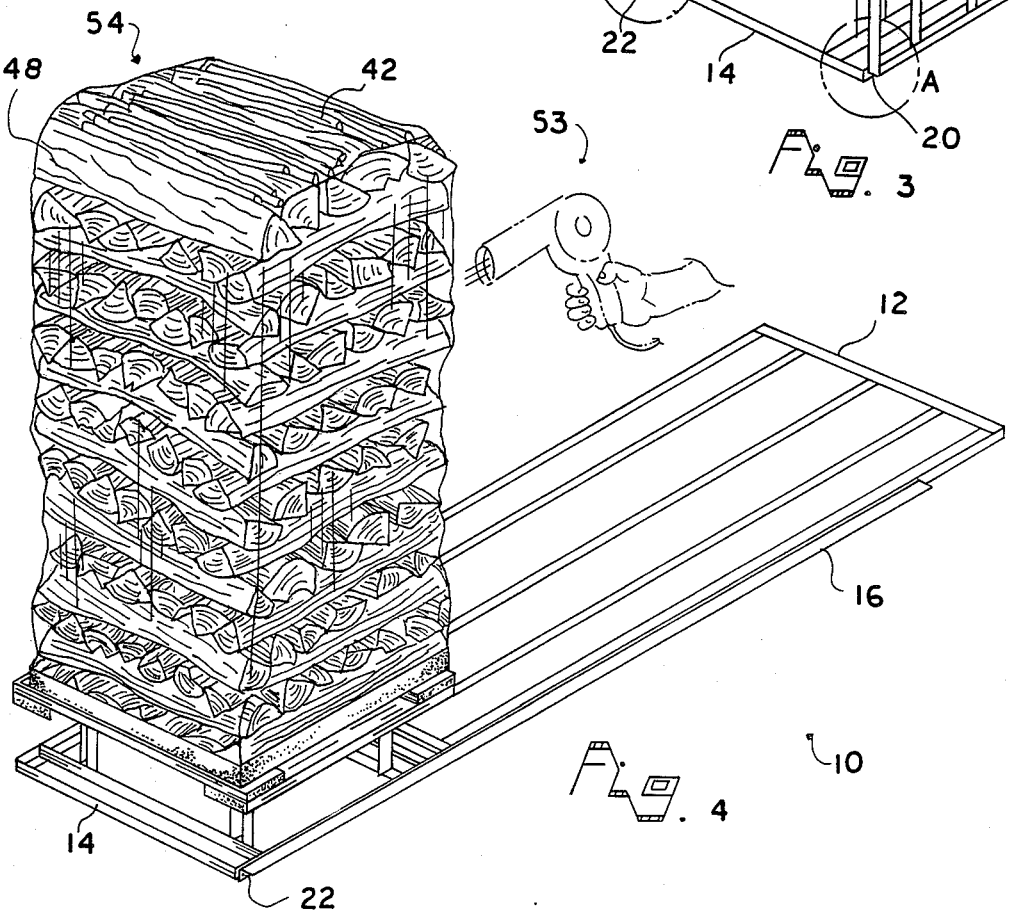

FIG. 4 is a left side perspective view of the apparatus of the invention, wherein the truss member of the device has been detachably removed. The figure also illustrates the firewood and kindling material tightly encased within the shrink wrap package of the device.

FIG. 4A side elevation view of a device and a corresponding method for removing the tightly encased firewood and kindling material thereof, in accordance with the invention.

Figure 5:
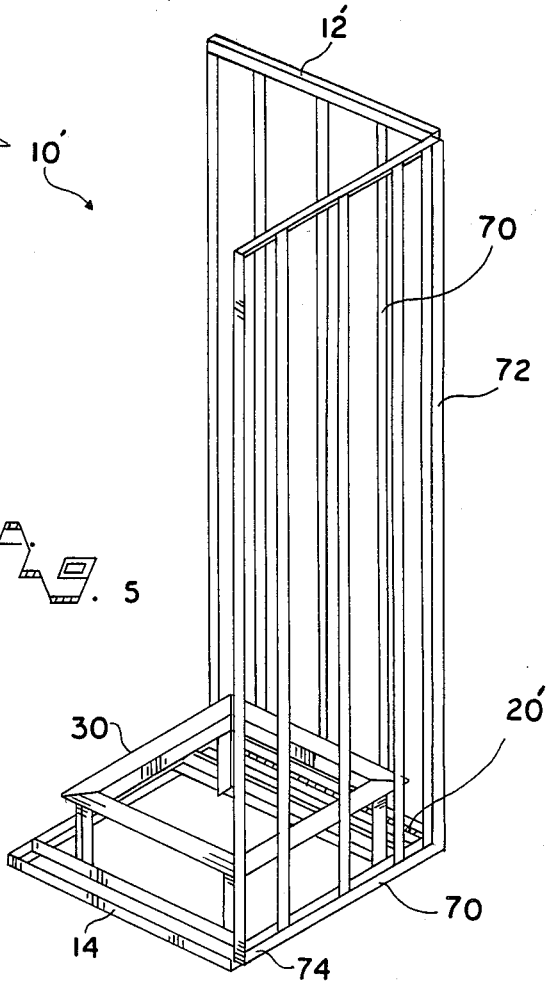

FIG. 5 is a perspective of an alternate embodiment of the apparatus for packaging firewood and the kindling material thereof, wherein the truss member of the invention is rigidly affixed to the vertical support member.

DESCRIPTION OF THE PREFERRED EMBODIMENT

Figure 1:
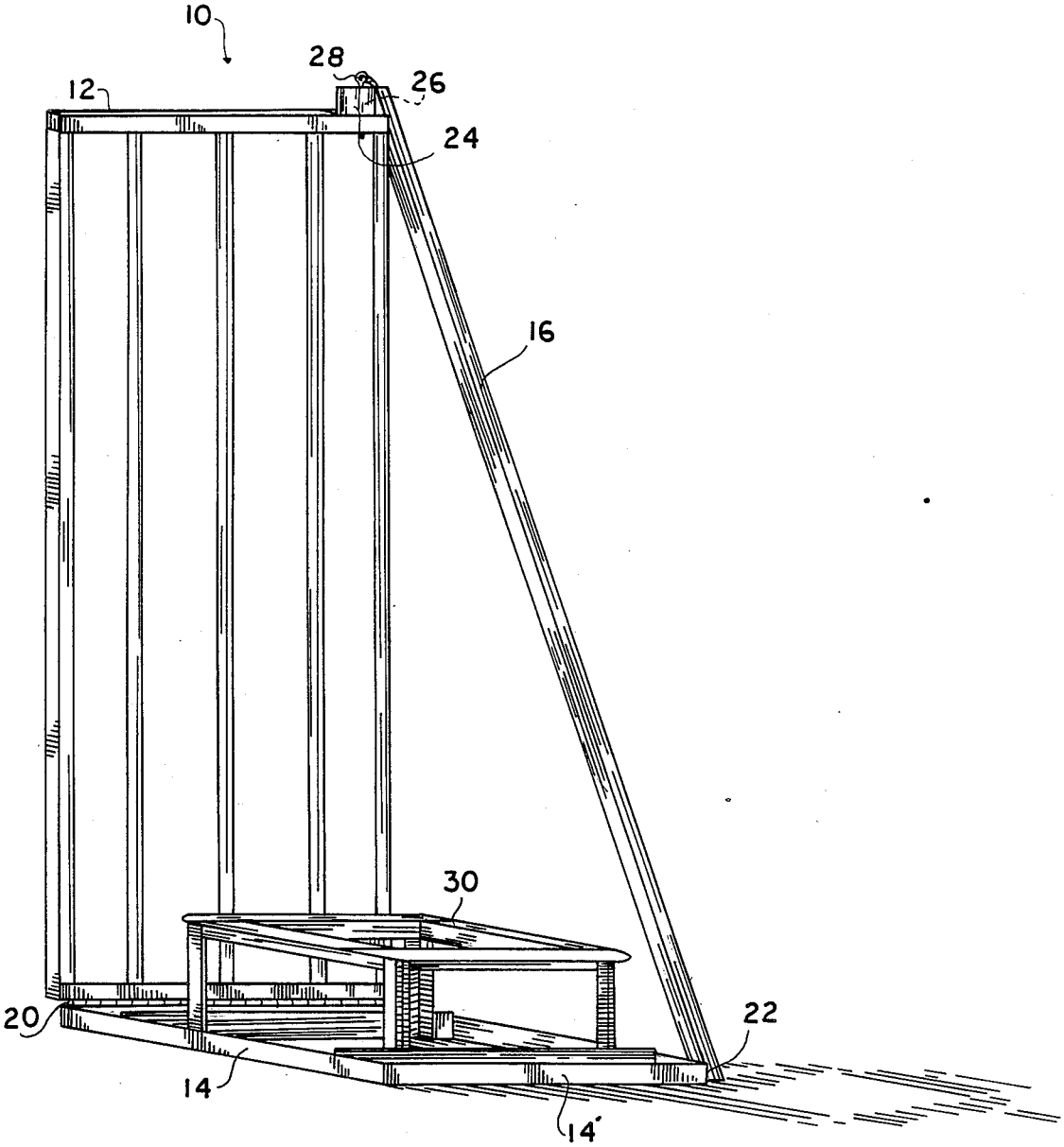
FIG. 1 is a right side perspective view of the present invention showing an apparatus for packaging firewood and kindling material.
Figure 2:
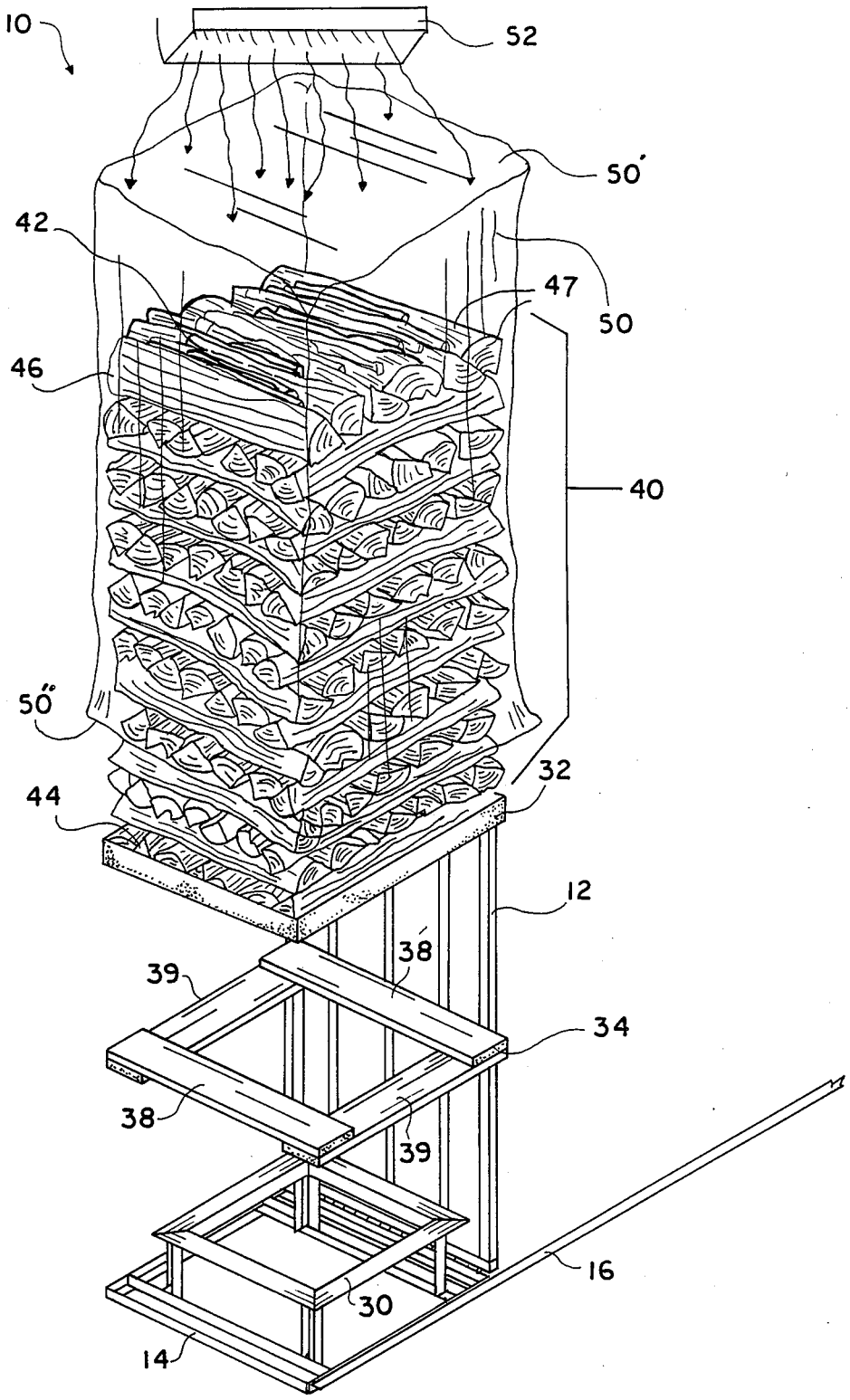
FIG. 2 illustrates an exploded view of the elements used in packaging firewood and kindling material in accordance with the invention.
Figure 3A:
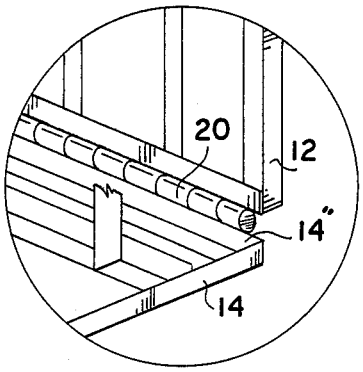
Figure 3B:
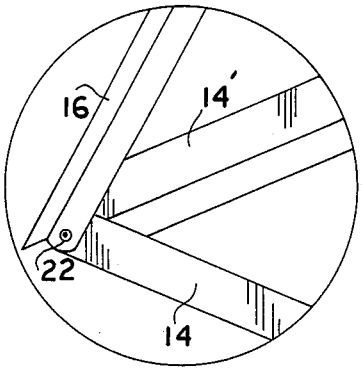
Figure 3C:
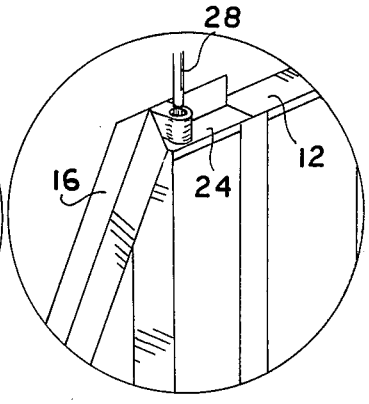

Referring now to the drawings, there is shown the device 10 in its preferred embodiment and best mode of operation, wherein the invention includes a rigid support frame 10, which includes base structure 14 having an elevated platform 30 disposed thereon. As seen (by schematic representation) in FIG. 2, base member 14 is provided, whereby a multiplicity of layers of split firewood 40 is stacked thereon. Each layer is constructed by placing individual pieces of substantially equal length firewood, similar to split firewood lengths 46, in parallel arrangement to one another. As shown and as will be apparent, each firewood length 46 exhibits randomly configured lateral or peripheral surfaces 47. A first or primary layer 44 is positioned within tray member 32, thereby forming a stable base for the stacking of the remaining layers 40. In order to provide lateral stability of the layers 40, each is arranged in a manner similar to that mentioned above, wherein each respective layer is stacked upon the preceding layer in substantially normal axial displacement to one another. It is seen that this arrangement provides for both lateral stability (as previously mentioned) and also produces minimal volume while constructing the stack of firewood. Manual direction of each layer against vertical support member 12 during vertical positioning of same, ensures axial alignment of the respective layers, with respect to the preceding and succeeding layers of same.

Upon stacking of the layers of firewood to the desired height or number of layers, as represented by indicia 13 on the face of vertical support truss member 16, the vertical support 12 may be detached by removing fastener pin 28 from shoulder 24 and pin receiving aperture 26 thereof. Truss member 16 is now pivotably displaced about pivot member 22, and positioned (along the ground) adjacent base member 14. The kindling material 42 may be placed on the terminating layer 48 of stacked firewood 40, either before or after removal of the fastener pin 28 from shoulder member 24.

Thermally shrinkable plastic or shrink wrap package 50 is disposed on the substantially vertically positioned stack of firewood 40 and kindling material 42, in a manner, whereby open end 50'' of the shrink wrap 50 extends below tray member 32. In this arrangement the open end 50'' may be secured beneath tray member 32, by a tie or string element (not shown).

Figure 6:
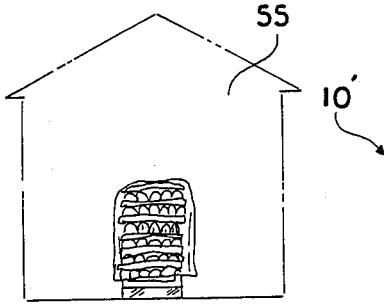

A conventional pallet member 34 is provided between elevated platform 30 and tray 32, wherein pallet 34 includes opposite side members 38, 38' juxtapositionally arranged upon remaining side members 39, 39', such that tie or string element (not shown) may be drawn and tied beneath the pallet 34 and corresponding tray member 32, prior to heating shrink wrap 50. Heating element 52 is employed about the outer surface of the thermally shrinkable material 50, such that applying said heat provides for a tightly encased package of firewood 40 and kindlng material 42 thereof. In order to ensure sufficient packaging, elevated platform 30, which includes an aperture therein, is provided such that heat may be applied to the bottom of the stack in the area surrounding the open end 50'' of the heat shrink wrap 50. As seen in FIG. 4, a tightly encased package 54 is now provided, which includes stacked firewood 40, kindling material 42, tray member 32, and pallet element 34, respectively. A portable, hand operated heating tool 53 may be employed or alternatively, the stacked assembly of FIG. 4 may be moved into an oven enclosure 55 as shown in FIG. 6.

The packaged material 54, may be easily removed, by use of hand truck 60. The hand truck is maneuvered by operator 62, away from platform 30, such that another stacking operation may be performed. Mechanical or automated methods for removing the tightly encased firewood 40 and kindling material 42 may alternatively be employed.

An alternate embodiment 10' for the apparatus is shown in FIG. 5, wherein the truss 70 is seen as structurally similar to vertical support 12'. In this embodiment, truss member 70 and vertical support 12' are rigidly affixed along common edge 72, in substantially normal displacement to one another. The pin fastener element 74, of this embodiment, is located adjacent to front part 14' of base member 14, such that upon removal of said pin fastener 74, said vertical support member 12' and truss member 70 may both be displaced about hinge member 20' and lowered in planar disposition to base member 14 (along the surface or ground).

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

What is claimed is:

1. A method for producing packages of firewood comprising the steps of;

cutting trees to produce substantially constant lengths of logs, splitting said logs to provide firewood lengths having irregularly configured peripheral surfaces, setting up a support frame having a base member including an elevated platform thereupon, said platform defining lateral dimensions less than that of said firewood lengths, said base member having front and rear portions, a vertical support member movably attached to said base member rear portion and braced by a truss member removably bracing said support member to said base member front portion, placing a substantially square support retainer member atop said platform, said support retainer member having side dimensions substantially equal to the length of said firewood lengths and projecting laterally a substantial distance beyond said platform therebeneath, depositing a substantially horizontal layer of parallel juxtaposed ones of said firewood lengths upon said retainer member to form a bottom most firewood layer, depositing succeeding substantially horizontal layers of parallel juxtaposed ones of said firewood lengths atop previously deposited ones of said layers with each said succeeding layer having said firewood lengths disposed with their longitudinal axes offset substantially 90 degrees from the longitudinal axes of the firewood lengths of the preceding layer, utilizing said vertical support member as a guide during said depositing of succeeding layers to facilitate maintenance of vertical alignment between said layers, moving said truss member and vertical support member away from said deposited layers, placing a bag of shrink wrap material having an open end about said layers of firewood lengths with said open end disposed below said support retainer member, and applying heat to said bag beginning at said open end to cause said bag to shrink with said open end closing beneath said support retainer member short of said elevated platform with the balance of said bag shrinking to tightly wrap and retain all said firewood lengths in a unitary stable bundle containing said support retainer member.

2. A method for producing packages of firewood according to claim 1 including;

cutting and splitting kindling material, and placing said kindling material atop the last one said deposited layer of firewood lengths.

3. A method for producing packages of firewood according to claim 1 wherein;

said step of applying heat is accomplished by directing a hand heating tool about said placed bag.

4. A method for producing packages of firewood according to claim 1 including;

removing said layers of firewood lengths and said support retainer member with said bag placed thereabout, from said elevated platform and placing whithin an oven, and said step of applying heat is accomplished by operating said oven.

5. A method for producing packages of firewood according to claim 1 including;

providing indicia on said vertical support member allowing a user to deposit a desired number of said succeeding layers as defined by said indicia.

6. An apparatus for packaging a plurality of cross-stacked layers of lengths of firewood of substantially constant length having randomly configured peripheral surfaces, comprising;

a rigid support frame including a base member having front and rear portions, a vertical support member having a bottom movably attached to said base member rear portion, a truss member removably bracing said vertical support member to said base member front portion, an elevated platform on said base member, said platform defining lateral dimensions substantially less than the axial extent of said firewood lengths, a substantially square support retainer member atop said platform, and said support retainer member having side dimensions each substantially equal to the axial extent of said firewood lengths and laterally projecting a substantial distance beyond said elevated platform therebeneath.

7. An apparatus for packaging a plurality of cross-stacked layers of lengths of firewood according to claim 6 wherein, said vertical support member and truss member include top portions, and removable fastening means normally retaining said vertical support member in a vertical disposition and operable to permit displacement of said vertical support member and truss member to a horizontal position.

8. An apparatus for packaging a plurality of cross-stacked layers of lengths of firewood according to claim 6 including, tray means having a bottom surface and a plurality of upstanding peripheral walls, and said tray means disposed atop said support retainer member.

* * * * *